US011628596B2

(12) United States Patent
Cussenot

(10) Patent No.: US 11,628,596 B2
(45) Date of Patent: Apr. 18, 2023

(54) CONCRETE CUTTING DUST ABATEMENT SYSTEMS AND METHODS

(71) Applicant: Precision Concrete Cutting, Inc., Provo, UT (US)

(72) Inventor: Marc Cussenot, Burlingame, CA (US)

(73) Assignee: Precision Concrete Cutting, Inc., Provo, UT (US)

( * ) Notice: Subject to any disclaimer, the term of this patent is extended or adjusted under 35 U.S.C. 154(b) by 650 days.

(21) Appl. No.: 16/670,737

(22) Filed: Oct. 31, 2019

(65) Prior Publication Data

US 2021/0129381 A1 May 6, 2021

(51) Int. Cl.

| | |
|---|---|
| ***B28D 7/02*** | (2006.01) |
| ***A47L 7/00*** | (2006.01) |
| ***B07B 7/00*** | (2006.01) |
| ***B28D 1/04*** | (2006.01) |

(52) U.S. Cl.

CPC ..... *B28D 7/02* (2013.01); *A47L 7/0095* (2013.01); *B07B 7/00* (2013.01); *B28D 1/04* (2013.01)

(58) Field of Classification Search

CPC ..... B28D 1/04; B28D 7/02; A47L 7/0095; B23Q 11/0046; B07B 4/00; B07B 4/02; B07B 7/00; B07B 7/01; B07B 7/08; B07B 7/086; B07B 7/0865; B07B 7/10; B07B 4/08

See application file for complete search history.

(56) References Cited

U.S. PATENT DOCUMENTS

| | | | | |
|---|---|---|---|---|
| 3,598,446 | A * | 8/1971 | Hatcher | E01C 23/088 451/352 |
| 4,678,560 | A * | 7/1987 | Stole | B07B 9/00 209/23 |
| 6,827,074 | B2 | 12/2004 | Gardner | |
| 6,896,604 | B1 | 5/2005 | Taylor et al. | |
| 7,000,606 | B2 | 2/2006 | Gardner | |
| 7,143,760 | B2 | 12/2006 | Gardner | |
| 7,201,644 | B2 | 4/2007 | Gardner | |
| 7,402,095 | B2 | 7/2008 | Gardner | |
| 2006/0169065 | A1 * | 8/2006 | Solomon | G01N 15/0272 73/863.21 |
| 2019/0125153 | A1 * | 5/2019 | Loveless | A47L 9/1683 |
| 2019/0136488 | A1 * | 5/2019 | Cochran | E02F 5/08 |

FOREIGN PATENT DOCUMENTS

JP 2013002947 A * 1/2013

OTHER PUBLICATIONS

Woodworking Beta, Questions, "Can you hook up two shop-vacs in parallel to increase airflow through a dust collection system," Mar. 29, 2017 [retrieved on Oct. 31, 2019]. Retrieved from Internet: <URL: woodworking.stackexchange.com/questions/5779/can-you-hook-up-two-shop-vacs-in-parallel-to-increase-airflow-through-a-dust-col>.

* cited by examiner

*Primary Examiner* — Daniel J Colilla

(74) *Attorney, Agent, or Firm* — Dentons Durham Jones Pinegar

(57) ABSTRACT

A system for reducing dust when flush-cutting concrete is described, and may include a first vacuum with a first vacuum line, a second vacuum with a second vacuum line, and a saw connected to a third vacuum line, with each of the vacuum lines fluidly connected through a Y-shaped manifold. The system may also include a cart to attach the vacuums to, the cart having an upper shelf for the first vacuum and a lower shelf for the second vacuum.

12 Claims, 2 Drawing Sheets

CONCRETE CUTTING DUST ABATEMENT SYSTEMS AND METHODS

TECHNICAL FIELD

This disclosure relates generally to systems and methods for dust abatement while cutting concrete. More particularly, this disclosure relates to dust abatement systems and methods that may be used in conjunction with flush-cutting concrete saws. Even more specifically, this disclosure relates to systems and methods for dust abatement that employ two vacuums fluidly connected via a manifold in a manner that significantly reduces dust.

RELATED ART

Trip hazards on sidewalks, which can be caused by uneven lifting and settling of contiguous sidewalk sections, present a safety hazard for users and a liability for municipalities. Conventionally, uneven joints caused by lifted and/or sunken sidewalk sections were addressed by demolishing, removing, and replacing one or both of the sections that define the joint. The demolition, removal, and replacement of concrete sections is time-consuming, expensive, and requires that concrete not be used (e.g., that part of a sidewalk not be used, etc.) for a prolonged period of time.

Concrete lifting processes have also been used to correct uneven sections. While concrete lifting is more effective than the demolition, removal, and replacement of concrete sections, and may require less down-time, concrete lifting is not always useful for addressing unevenness between adjacent concrete sections. In particular, concrete lifting cannot be used to correct unevenness that has been caused by factors that have already lifted one or more sections of concrete, such as the roots of growing trees and shrubberies.

The use of sawing and grinding techniques have also been used to address uneven sections of concrete. Conventional techniques for sawing and grinding concrete are often accompanied by the use of large quantities of water for cooling and to prevent the spread of the large quantities of dust that are typically generated while cutting or grinding the concrete. The use of water to abate the dust generating by cutting or grinding concrete can be undesirable, especially in situations where large volumes of water are required, as it may be difficult to provide the necessary volume of water at the site and the water will be discarded.

Accordingly, various other techniques and apparatuses have been developed to reduce or eliminate unevenness at the joints between adjacent concrete sections, including trip hazards on sidewalks. U.S. Pat. Nos. 6,827,074; 6,896,604; 7,000,606; 7,143,760; 7,201,644; and 7,402,095, the entire disclosures of which are incorporated herein by reference, disclose methods and apparatuses for removing a trip hazards from concrete sidewalks. Using these methods and apparatuses, a trip hazard may be removed over the entire width of a sidewalk by a so-called "flush cutting operation." In a flush cutting operation, a portion of one or both concrete slabs of a pair of adjacent concrete slabs that meet at a common joint may be chamfered without necessitating the pulverization of material removed while chamfering a portion of one or both slabs adjacent to the common joint. A right-angle grinder motor, in combination with a specially-designed hub and a circular diamond-grit-edged blade, is employed to chamfer the trip hazard in a flush-cutting operation.

While flush cutting techniques are useful in reducing or eliminating trip hazards, the process of cutting of the concrete may generate large amounts of dust. Dust can cause secondary problems such as breathing hazards. Concrete is a mixture of hydrated (i.e., crystalized) cement, aggregate (gravel) and silica sand, so the dust created contains both cement dust and silica dust. Statistical evidence has shown that the breathing of silica dust can cause lung cancer, so the saw operator and those in the vicinity of the work often take precautions to be protected from the dust. For example, a dust abatement hood may be provided on the saw. Additional protection to prevent dust from escaping the system may be beneficial in terms of safety and aesthetics. In some jurisdictions, governmental regulations require that dust be decreased to levels that are well below the capabilities of existing flush cutting techniques and equipment. For example, major cities, including San Francisco, Calif., and Seattle, Wash., monitor air quality, and prohibit activities that generate noticeable (e.g., to individuals, to air quality monitors mounted on lamp posts, etc.) levels of dust.

SUMMARY

Dust abatement systems and methods according to this disclosure are tailored to prevent any dust generated by power tools from escaping into the environment. Without limitation, dust abatement systems and methods according to this disclosure may prevent dust generated by cutting, abrading, or otherwise mechanically removing concrete (e.g., with flush cutting equipment, etc.) from escaping into the environment in which the concrete is located.

A dust abatement system of this disclosure may include a first vacuum, a second vacuum, and a manifold connecting, or between, inputs of the first vacuum and the second vacuum. In addition, the dust abatement system may include an apparatus for cutting concrete (e.g., a concrete saw, such as a flush cutting concrete saw; a dust abatement hood associated with the concrete saw; etc.) The dust abatement system may also include a power supply, which may provide power to the first vacuum, the second vacuum, and the apparatus for cutting concrete. The carrier may carry the first vacuum, the second vacuum, and the optional power supply, and readily facilitates transportation of the dust abatement system to the location of a flush cutting operation while minimizing the size of the overall obstacle created by the flush cutting operation at that location and minimizing the extent to which the flush cutting operation will affect other activities in the vicinity of the flush cutting operation.

In some embodiments, including those where the dust abatement system includes a carrier, the first vacuum may be positioned above the second vacuum, or at a first elevation that exceeds a second elevation of the second vacuum. The second vacuum may have a greater volume flow than the first vacuum. Alternatively, the volume flows of the first vacuum and the second vacuum may be approximately equal to each other.

The manifold may include a first opening for attachment to the first vacuum, a second opening for attachment to the second vacuum, and a third opening for attachment to a power tool, such as a concrete saw, directly or through a dust abatement hood of the power tool. A first hose may connect the first opening of the manifold to an inlet of the first vacuum. A second hose may connect the second opening of the manifold to an inlet of the second vacuum. A third hose may connect the third opening of the manifold to a power tool or to a dust abatement hood associated with the power tool. The manifold may have a generally Y-shape. The first opening, the second opening, and the third opening may be approximately equidistant or equidistant from one another.

The lengths of the first hose and the second hose may be substantially the same or the same as one another. The manifold may comprise at least one adapter configured to connect at least one of the first vacuum to the first opening of the manifold and the second vacuum to the second opening of the manifold. The manifold may equalize the volume flows of the first vacuum and the second vacuum, even in embodiments where the first vacuum has a lower volume flow rating than the second vacuum.

The carrier of the dust abatement system may include a first shelf above a second shelf. The first vacuum may be positioned on the first shelf and the second vacuum may be positioned on the second shelf.

A method for reducing dust is also described, and may include the following elements, which need not be taken in the order given: selecting a manifold, the manifold comprising a first opening, a second opening, and a third opening; connecting a first vacuum to the first opening of the manifold; connecting a second vacuum to the second opening of the manifold; connecting a power tool to the third opening of the manifold; and operating the first vacuum and the second vacuum while operating the power tool. The second vacuum may have a greater volume flow than the first vacuum. The first vacuum may be positioned over the second vacuum. More specifically, the first vacuum may be placed on a first shelf of the carrier, while the second vacuum may be placed onto a second shelf of the carrier.

In embodiments where the power tool is a concrete saw, a dust abatement system or method according to this disclosure may collect substantially all of the concrete dust generated by use of the concrete saw. This may include more than 90% of the concrete dust, at least 95% of the concrete dust, at least 98% of the concrete dust, or at least 99% of the concrete dust. In some embodiments, the amount of dust captured by a dust abatement system or method according to this disclosure may be sufficient to have any effect on the overall air quality (e.g., as measured by dust monitors, etc.) in the vicinity of the location of the concrete removal operation (e.g., the flush cutting operation, etc.).

Other aspects of the disclosed subject matter, as well as advantages of various aspects of the disclosed subject matter, should be apparent to those of ordinary skill in the art through consideration of the ensuing description, the accompanying drawings, and the appended claims.

BRIEF DESCRIPTION OF DRAWINGS

The following drawings illustrate what are currently considered to be specific representative configurations for carrying out the disclosed subject matter and are not limiting as to embodiments which may be made in accordance with this disclosure. The components in the drawings are not necessarily to scale relative to each other. Like reference numerals designate corresponding parts throughout the several views.

DETAILED DESCRIPTION

Reference in the specification to "one configuration," "one embodiment," "a configuration," or "an embodiment" means that a particular feature, structure, or characteristic described in connection with the configuration is included in at least one configuration, but is not a requirement that such feature, structure, or characteristic be present in any particular configuration unless expressly set forth in the claims as being present. The appearances of the phrase "in one configuration" in various places may not necessarily limit the inclusion of a particular element of the invention to a single configuration, rather the element may be included in other or all configurations discussed herein.

Furthermore, the described features, structures, or characteristics of configurations of the disclosed subject matter may be combined in any suitable manner in one or more configurations. In the following description, numerous specific details are provided to provide a thorough understanding of configurations of the invention. One skilled in the relevant art will recognize, however, that embodiments of the disclosed subject matter may be practiced without one or more of the specific details, or with other methods, components, materials, and so forth. In other instances, well-known structures, materials, or operations are not shown or described in detail to avoid obscuring aspects of the invention.

It should also be noted that, as used in this specification and the appended claims, singular forms such as "a," "an," and "the" may include the plural unless the context clearly dictates otherwise. For example, reference to "a vacuum" may include one or more of such vacuums, and reference to "the manifold" may include reference to one or more of such manifolds.

The present disclosure generally relates to a dust abatement system for use with power tools, such as concrete saws that may be used in flush-cutting concrete. The system may generally comprise one or more of the following elements: a first vacuum, a second vacuum, and a manifold to fluidly connect the first vacuum and the second vacuum. The dust abatement system may also include a power tool, such as a concrete saw with a dust abatement hood. In some configurations the system may also include a carrier (e.g., a moveable cart, etc.) with an upper shelf for the first vacuum and a lower shelf for the second vacuum.

Figure 1:
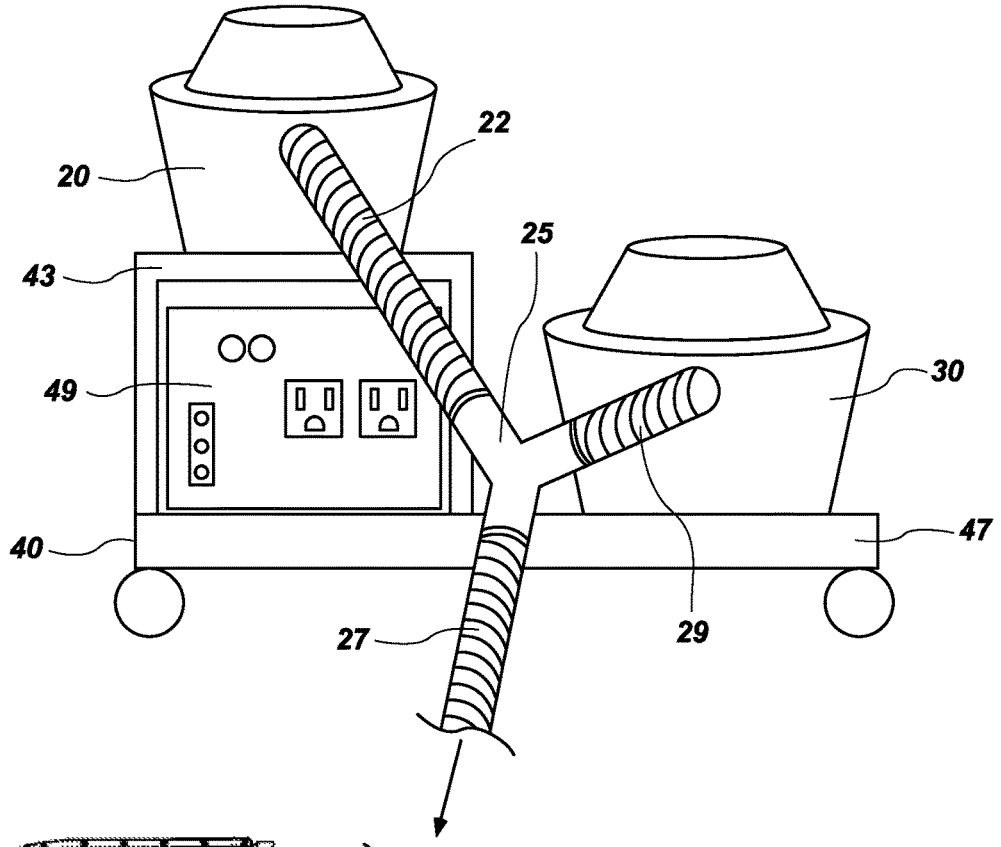
FIG. 1 shows a perspective view of one configuration of the dust reduction system as described herein.
Figure 1:
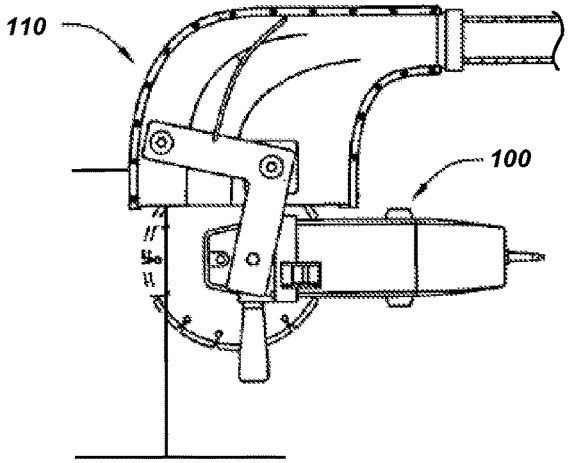

FIG. 1 shows a perspective view of an embodiment of dust abatement system 10. A first vacuum 20 may be positioned higher, or above, a second vacuum 30. In some configurations, the first vacuum 20 may be smaller than the second vacuum 30 or, in other words, have less power or volume flow than the second vacuum 30. For example, the first vacuum may have a volume flow of about 200 cubic feet per minute (CFM), while the second vacuum 30 may have a volume flow of about 300 CFM. In other configurations, the volume flows of the first vacuum 20 and the second vacuum 30 may be equal (e.g., both about 300 CFM, etc.).

Vacuum airflow takes into account both the power of the vacuum motor, which creates suction, as well as the resistance of the bag and filter system that the air must pass through. The volume airflows of the first vacuum 20 and the second vacuum 30 are measured through the vacuum cleaner without hose or attachments connected. Because of this, there are several factors that can affect actual airflow, including turbulence in the hoses, the lengths of the hoses, restrictions on airflow during use of the dust abatement system 10, increased resistance due to the container of a vacuum 20, 30 filling with dirt, as well as filter loading. The actual airflow when the first vacuum 20 and the second vacuum 30 are included in the dust abatement system 10, therefore, is typically different than the stated volume airflow for each vacuum 20, 30.

Each of the first vacuum 20 and second vacuum 30 may be fluidly connected to each other and/or to a power tool 100, such as a concrete saw (e g., a flush-cutting concrete saw, etc.), with a dust abatement hood 110, via a manifold 25. The manifold 25 may be generally Y-shaped. The manifold 25 may generally include a first opening 32 for attachment to the first vacuum 20, a second opening 34 for attachment to the second vacuum 30, and a third opening 37 for attachment to the power tool 100. In some configurations, the first, second, and third openings 32, 34, and 37 may be spaced approximately equidistant from one another, about 120 degrees apart. The third opening 37 may be configured to attach directly or indirectly to the power tool 100. As an example of an indirect connection, the third opening 37 may connect (e.g., by way of a hose 27, etc.) to a dust abatement hood 110 (e.g., a vacuum hood, vacuum port, etc.) of the power tool 100. The power tool 100 may be fluidly connected to the third opening 37 of the manifold 25 via other suitable mechanisms as well.

Figure 2:
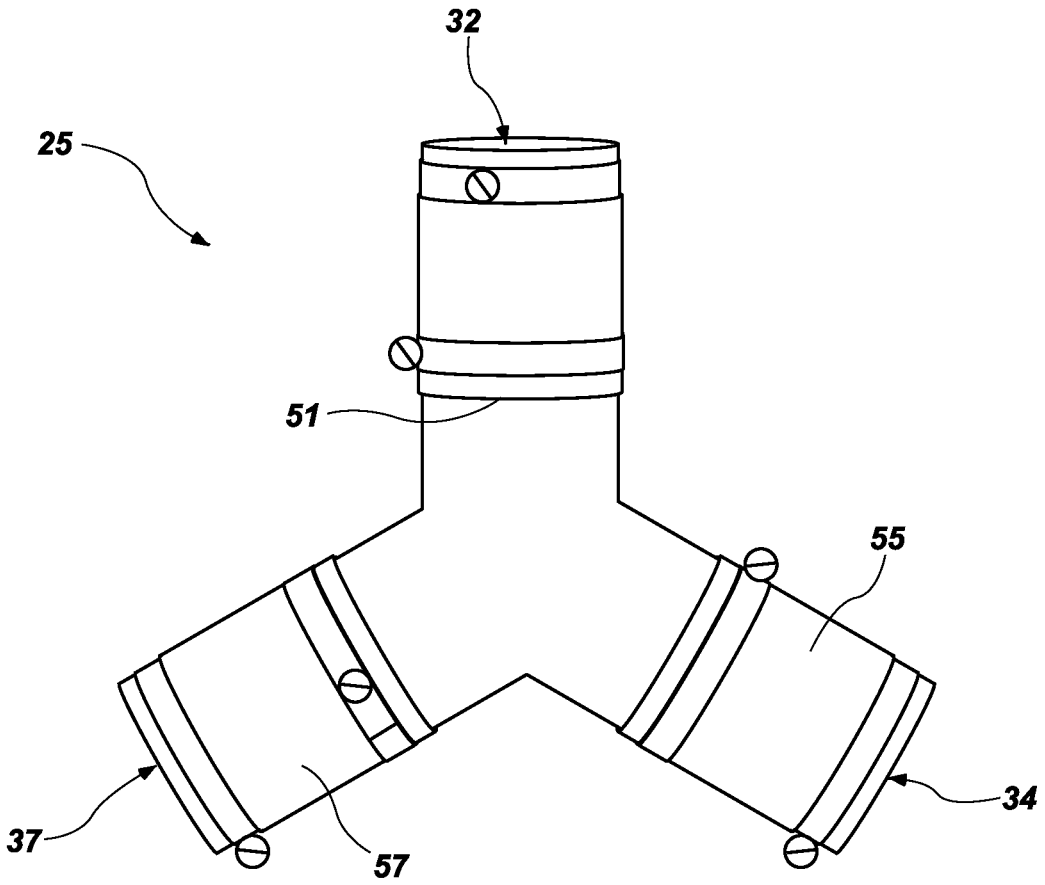
FIG. 2 shows a perspective view of one configuration of a manifold that may be used in conjunction with the system described herein.

In some configurations, the manifold 25 may be provided with one or more adapters for connection to the first vacuum 20, second vacuum 30, and the power tool 100. As seen in FIG. 2, adapters 51, 55, and 57 may be provided on each arm of the manifold 25. In some configurations, the adapters are not used and the vacuum tubing may be connected directly to the manifold 25. In other configurations, one, two, or three or more adapters may be used as necessary to connect the vacuum lines to the manifold 25.

The dust abatement system 10 may also include a carrier, such as the depicted cart 40, for the first vacuum 20 and second vacuum 30. The cart 40 may include a first shelf 43 and a second shelf 47. The first shelf 43 may be positioned vertically above the second shelf 47. When the first vacuum 20 is positioned on the first shelf 43, it may be located above the second vacuum 30 on the second shelf 47. The first shelf 43 may be, for example, about 0.5 meter (M) to about 1 M above the second shelf 47. The first shelf 43 may be directly above the second shelf 47, or the first shelf 43 may be located proximal to and above the second shelf 47, as shown in FIG. 1. A space for a power supply 49, such as a generator, may also be provided on the cart 40. The cart 40 may have a configuration that enables it to be pushed, pulled, and/or towed.

As an alternative to a manually moved or unmotorized carrier, such as the embodiment of cart 40 shown in FIG. 1, the carrier may be motorized and, in some embodiments, driven. Such a carrier may comprise a motorized cart, a vehicle (e.g., a utility vehicle (UTV), an all-terrain vehicle (ATV), etc.), or the like.

When the first vacuum 20 and the second vacuum 30 are positioned in with the first vacuum 20 at a higher elevation than the second vacuum 30 and connected to each other via manifold 25, the volume flow of the first vacuum 20 may be less than the volume flow of the second vacuum 30. The difference in volume flows and the difference in elevations may enable the first vacuum 20 to primarily receive smaller particles (i.e., a majority of the particles, by number, by volume, or by weight, received by the first vacuum may comprise smaller particles), such as inhalable particles (e.g., particles having a size of about 250 μm or less; particles having a size of about 100 μm or less; particles having a size of about 50 μm or less; inhalable coarse particles having a size of about $PM_{10}$, or 10 μm to 2.5 μm; fine particles having a size of about $PM_{2.5}$, or 2.5 μm or less; ultrafine particles; etc.), which may be harmful if inhaled by an individual, and the second vacuum 30 to primarily receive larger particles (i.e., a majority of the particles, by number, by volume, or by weight, received by the first vacuum may comprise smaller particles) (e.g., particles having a size of more than $PM_{10}$, or 10 μm, particles having a size of about 50 μm or more, particles having a size of about 100 μm or more, particles having a size of about 250 μm or more, etc.). The differential volume flows, gravity, and the relative positions of the first vacuum 20 and the second vacuum 30, and/or other factors, such as the generation of a centrifugal force within the dust abatement system 10 and the extent to which various sizes of particles of the dust contact interior surfaces of the hoses and manifold of the dust abatement system 10, may enable particles to be sorted on the basis of their size and, thus, their weight. Sorting the particles between the first vacuum 20 and the second vacuum 30 may enable the first vacuum 20 and the second vacuum 30 to draw approximately equal amounts (e.g., volumes, etc.) of dust, which may prevent premature clogging of a filter of one of the first vacuum 20 and the second vacuum 30, thereby enabling the first vacuum 20 and the second vacuum 30 to operate for approximate equal durations before waste removal and/or maintenance (e.g., filter cleaning, filter replacement, etc.) are required.

Alternatively. the volume flow of the first vacuum 20 may be approximately equal to the volume flow of the second vacuum 30 within the dust abatement system 10. In other words, the volume flow may be equalized or substantially equalized within the dust abatement system 10, even in embodiments where the first vacuum 20 is smaller than the second vacuum 30, or an individual first volume flow of the first vacuum 20 is less that an individual second volume flow of the second vacuum 30. Such equalization may be due to any of a variety of factors, including, without limitation, the connection of the first vacuum 20 and the second vacuum 30 to one another, a configuration of the manifold 25, a placement of the manifold 25 relative to the first vacuum 20 and the second vacuum 30, the relative positions of the first vacuum 20 and the second vacuum 30, and/or other characteristics of the manner in which the dust abatement system 10 is configured.

The configuration may allow two smaller vacuums 20 and 30 to, in connection with the manifold 25, have more volume flow than the sum of their individual volume flows. The use of two relatively small vacuums 20 and 30 may enable the dust abatement system 10 to be more easily transported and less obtrusively used on a sidewalk, when compared to the use of one much larger vacuum. This may assist the worker operating the concrete saw as well as the sidewalk users who must navigate the sidewalk around the worker and the equipment.

In use, a worker may position the first vacuum 20 at a higher elevation than the second vacuum 30. More specifically, the first vacuum 20 may be positioned on the first shelf 43 of the cart 40, while the second vacuum 30 may be positioned on the second shelf 47 of the cart 40. This may be done via any suitable connection means, such as cords, rope, chain, etc. The attachment may be a removable attachment or a non-removable attachment. In some configurations, a removable attachment may be used so the first vacuum 20 and the second vacuum 30 can secured to their respective first shelf 43 and second shelf 47, but readily removed from the cart 40 for emptying, service, and replacement, as needed. The hoses 22 and 29 of the first vacuum 20 and the second vacuum 30, respectively, may be connected to the manifold 25. Another hose 27 may be attached from the manifold 25 to the power tool 100, such as to a dust abatement hood 110 of the power tool 100. The worker may also attach a power supply 49 to the cart 40 and connect one or more of the power tool 100, the first vacuum 20, and the second vacuum 30 to the power supply 49, as needed. It will be appreciated that many times, this initial set-up of the dust abatement system 10 may be already previously completed, and the worker may just place the cart 40 with the first vacuum 20 and second vacuum 30, the power supply 49, etc., proximal to the location of their work and begin their work.

As the worker proceeds to cut or otherwise remove concrete, the draw from the first vacuum 20 and the second vacuum 30, each fluidly attached to the power tool 100 via the hose 27 and manifold 25, may pull most of the dust created by the power tool 100 toward the manifold 25. As dust reaches the manifold 25, it may experience a centrifugal force, which may have an effect on the momentum of different sizes of the dust particles or otherwise affect the manner in which different sizes of the particles of dust are sorted between the first vacuum 20 and the second vacuum 30. The manner in which various sizes of dust particles interact with (e.g., contact, impact, etc.) the interior surfaces of the hoses 22, 27, 29 and the manifold 25 may also affect the manner in which different sizes of the dust particles are sorted. Additionally, the volume flows of the first vacuum 20 and the second vacuum 30, the relative positions of the first vacuum 20 and the second vacuum 30, and/or the force of gravity on the dust particles may affect sorting of different sizes of the dust particles. Smaller particles may be removed toward and primarily collected by a canister of the first vacuum 20. Larger particles may be removed toward and primarily collected by a canister of the second vacuum 30. This may allow, for example, substantially all of the dust created by use of the power tool 100 to be abated by the dust abatement system 10. In various embodiments, the dust abatement system 10, alone or together with a dust abatement hood 110 of the power tool 100, may remove more than 90% of the dust, at least 95% of the dust, at least 98% of the dust, or at least 99% of the dust.

This configuration may also make it easier for a worker to perform the work of cutting the concrete because it allows the worker to take a smaller cart with two vacuums on it rather than a cart with a very large vacuum. The smaller cart may be easier for the worker to move, and also may occupy less space on the sidewalk.

The various embodiments described above, including elements of the various embodiments described above, can be combined to provide further embodiments. Various portions and components of apparatuses within the scope of this disclosure, including for example, structural components, can be formed by one or more various suitable manufacturing processes known to those in the art. Similarly, various portions and components of apparatuses within the scope of this disclosure can be made from suitable materials known to those in the art.

The above description has set out various features, functions, methods, and other aspects of the disclosure. Time and further development may change the manner in which the various aspects are implemented. For example, the disclosure is specifically discussed with applications to flush-cutting concrete. However, the dust abatement system and methods may have other applications outside of flush-cutting concrete.

The scope of protection defined by the claims is not intended to be limited to the specific sizes, shapes, features, or other aspects of the disclosed embodiments. The claimed inventions may be implemented or embodied in other forms while still being within the concepts disclosed hereby. Also included are equivalents of the elements of the claims that can be made without departing from the scopes of concepts properly protected by the claims that follow.

What is claimed:

1. A system for reducing dust when cutting concrete, the system comprising:

a concrete saw;

a first vacuum including an inlet and having a first volume flow;

a second vacuum positioned below the first vacuum, including an inlet, and having a second volume flow that exceeds the first volume flow;

a manifold comprising a first opening, a second opening, and a third opening;

a first conduit between the first opening of the manifold and the inlet of the first vacuum; and a second conduit between the second opening of the manifold and the inlet of the second vacuum, the third opening establishing communication between the concrete saw and the manifold, the first vacuum, and the second vacuum.

2. The system of claim 1, wherein the concrete saw comprises a flush-cutting concrete saw.

3. The system of claim 1, wherein the concrete saw includes a dust abatement hood.

4. The system of claim 1, wherein the manifold has a Y-shape.

5. The system of claim 1, further comprising:

a carrier for the first vacuum and the second vacuum.

6. The system of claim 5, wherein the carrier has a size that enables it to transport the first vacuum and the second vacuum to a worksite while minimizing disruption of normal activity at the worksite.

7. The system of claim 6, wherein the carrier comprises a cart, a utility vehicle, or an all-terrain vehicle.

8. The system of claim 5, wherein the carrier includes:

a first shelf that carries the first vacuum at a first elevation; and a second shelf that carries the second vacuum at a second elevation, the second elevation being lower than the first elevation.

9. The system of claim 5, further comprising:

a power supply on the carrier, the power supply selectively providing power to the first vacuum, the second vacuum, and a concrete saw.

10. The system of claim 1, wherein an elevation, a first volume flow of the first vacuum, and/or the manifold enables the first vacuum to primarily collect particles having sizes of $PM_{10}$ and smaller and the second vacuum to primarily collect particles having sizes of greater than $PM_{10}$.

11. A method for reducing dust when flush-cutting concrete, comprising:

connecting a first vacuum to a first opening of a manifold;

connecting a second vacuum located at a lower elevation than the first vacuum to a second opening of the manifold;

connecting a dust abatement hood of a concrete saw to a third opening of the manifold;

operating the first vacuum and the second vacuum;

operating the concrete saw, including cutting concrete with the concrete saw;

drawing first particles having sizes of $PM_{10}$ and smaller into the manifold and primarily collecting the first particles with the first vacuum; and drawing second particles having sizes of greater than $PM_{10}$ into the manifold and primarily collecting the second particles with the second vacuum.

12. The method of claim 11, wherein operating the concrete saw comprises operating a flush-cutting concrete saw.

* * * * *